US005192841A

United States Patent [19]

Milianowicz et al.

[11] Patent Number: 5,192,841

[45] Date of Patent: Mar. 9, 1993

[54] CIRCUIT BREAKER WITH SHOCK ABSORBING MECHANISM

[75] Inventors: Stanislaw A. Milianowicz, Monroeville; Edward J. Klimek, Jeannette; Robert N. Krevokuch, West Newton, all of Pa.

[73] Assignee: Westinghouse Electric Corp., Pittsburgh, Pa.

[21] Appl. No.: 788,700

[22] Filed: Nov. 6, 1991

[51] Int. Cl.[5] ..... H01H 3/60

[52] U.S. Cl. ..... 200/288; 335/46; 335/193

[58] Field of Search ..... 200/288, 400, 401, 327; 335/46, 193, 247, 248, 249, 257, 271, 277

[56] References Cited

U.S. PATENT DOCUMENTS

| | | | |
|---|---|---|---|
| 3,182,157 | 5/1965 | Brumfield | 200/288 X |
| 4,263,492 | 4/1981 | Maier et al. | 200/288 |
| 4,267,419 | 5/1981 | Maier et al. | 200/288 |
| 4,295,024 | 10/1981 | Kamp | 200/288 |
| 4,563,557 | 1/1986 | Leone | 200/288 |
| 4,612,429 | 9/1986 | Milianowicz | 200/288 |
| 4,650,946 | 3/1987 | Maier et al. | 200/288 |
| 4,713,503 | 12/1987 | Kamp | 200/288 X |
| 4,786,771 | 11/1988 | Iio et al. | 200/288 X |
| 4,891,617 | 1/1990 | Beatty et al. | 335/46 |

FOREIGN PATENT DOCUMENTS

| | | | |
|---|---|---|---|
| 196305 | 4/1923 | United Kingdom | 335/46 |

*Primary Examiner*—Henry L. Recla
*Assistant Examiner*—Glenn T. Barrett
*Attorney, Agent, or Firm*—M. J. Moran

[57] ABSTRACT

A circuit breaker having a chassis, an electrical contact structure, and a shock absorber mechanism. The contact structure includes a movable first electrical contact and a second electrical contact. The first contact has a first movement range. The shock absorbing mechanism, which absorbs energy from the movement of the first contact, includes a metallic bar pivotally mounted on the chassis, and first and second limit members fixed to the chassis. The first and second limit members define a second movement range which overlaps the first movement range. A spring weakly biases the metallic bar towards the second limit member. The first contact, during movement thereof to an open position, strikes the metallic bar. Kinetic energy is removed from the first electrical contact by the metallic bar without bounce of the electrical contact, and the metallic bar pivots against the first limit member, transferring the shock of stopping the first contact to the chassis.

8 Claims, 4 Drawing Sheets

CIRCUIT BREAKER WITH SHOCK ABSORBING MECHANISM

TECHNICAL FIELD

The invention relates in general to circuit breakers, and more specifically to power circuit breakers having means for non-destructively absorbing the shock of a movable contact arm without rebound.

BACKGROUND ART

Three-phase power circuit breakers conventionally have an electrical contact structure which includes three movable contact arms, one for each pole unit, which are connected to an electrical load, and associated relatively stationary contacts connected to a three-phase AC power source. A drive bar links all three movable contact arms for simultaneous opening and closing movement thereof, with the drive bar and contact arms being hereinafter called "movable contact means". A stored energy operating mechanism rapidly moves the movable contact means to a closed position in which electrical contacts on the contact arms engage the relatively stationary contacts.

Energy is stored in springs during the closing movement, with the springs aiding in rapid disengagement of the contacts when the circuit breaker is manually tripped, and when it is automatically tripped due to a circuit problem, such as over current and under voltage. When a circuit breaker is tripped, it is important that the movable contact means be rapidly accelerated to an open position in order to initiate rapid and effective arc interruption. The movable contact means has substantial inertia, and thus it is also important that the movable contact means be stopped at the desired open position without rebound, which could cause re-striking of an arc, and without damage to the movable contact means or other circuit breaker components.

SUMMARY OF THE INVENTION

The invention is a circuit breaker having a chassis, and electrical contact means insulatively supported by the chassis. The electrical contact means includes pivotable first electrical contact means and relatively stationary second electrical contact means, with a suitable operating mechanism pivoting the first electrical contact means between closed and open positions in which the first and second contact means are respectively engaged and disengaged. The first contact means has a first angular movement range which includes first and second limits at the open and closed positions.

The circuit breaker further includes shock absorbing means for absorbing energy from the movement of the first electrical contact means. The shock absorber means includes at least one metallic bar pivotally mounted on the chassis, and first and second limit means which respectively establish first and second limit positions for the pivotable movement of the metallic bar. The first and second limit means defines a second angular movement range in which the second limit of the second range overlaps the first limit of said first range. The shock absorber means further includes bias means which biases the metallic bar towards the second limit position of the second movement range.

The first electrical contact means, during movement thereof to the open position, strikes the metallic bar. The first electrical contact means is stopped without bounce or rebound, with the metallic bar absorbing the kinetic energy of the first electrical contact, resulting in the pivoting of the metallic bar against the first limit means. In a preferred embodiment of the invention, the metallic bar is sized to absorb the kinetic energy in two or more rapid steps, which minimizes shock and damage to the circuit breaker components.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
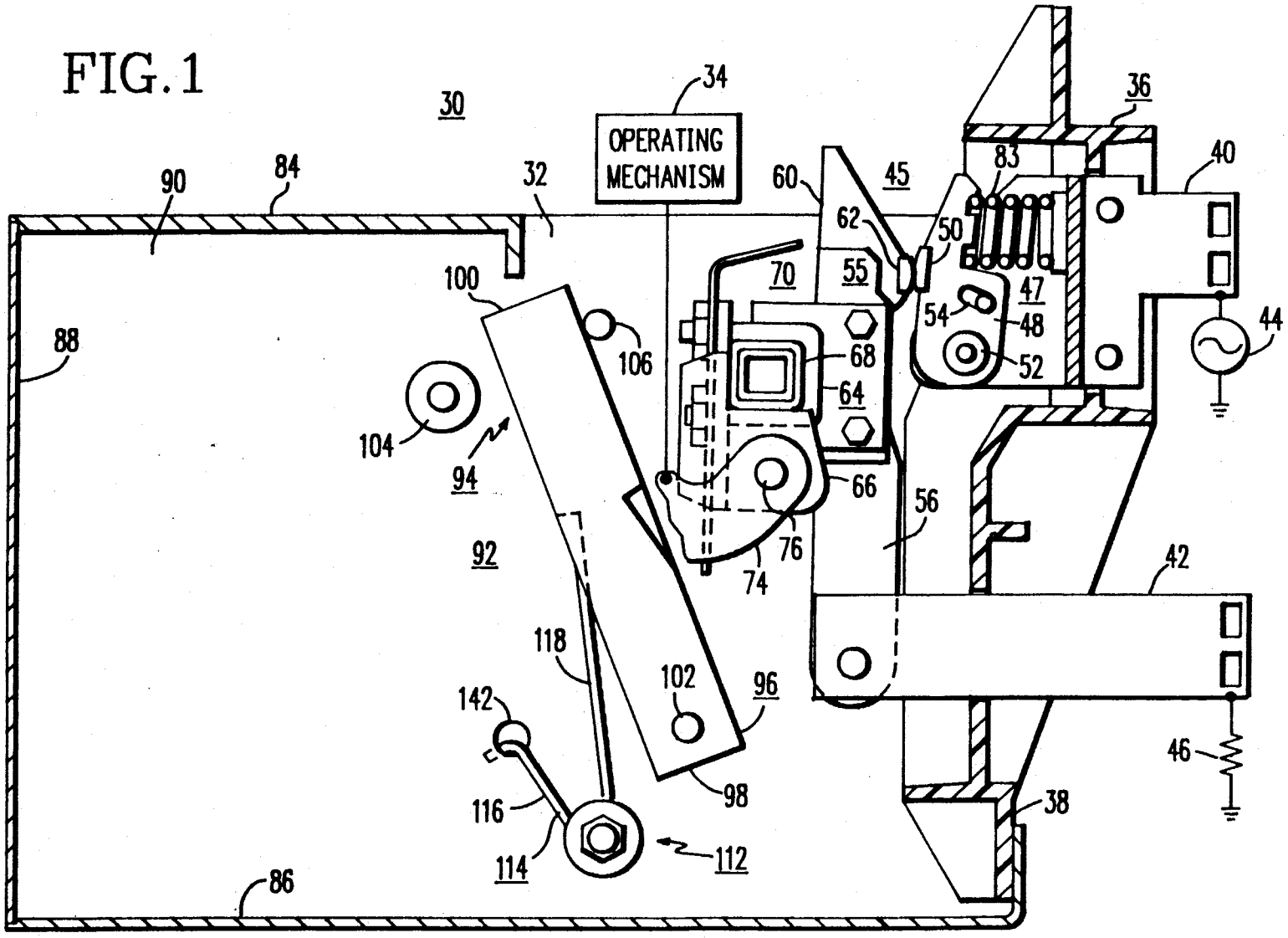
FIG. 1 is a side elevational view, partially in section and with some parts removed, of a circuit breaker, shown in a closed position, which has a shock absorbing mechanism constructed according to the teachings of the invention.

Referring now to the drawings, and to FIG. 1 in particular, there is shown a side elevational view, partially in section and with some parts not shown, of a circuit breaker 30 constructed according to a preferred embodiment of the invention. For purposes of example, circuit breaker 30 is illustrated as being an AC power circuit breaker of the type which is usually supplied as part of low voltage metal enclosed switchgear of the drawout type, but it may also be supplied in a fixed mounted version, as desired. Further, the principles and concepts of the invention apply equally to any circuit breaker having a movable contact assembly which must be stopped without bounce or rebound, and with no damage to circuit breaker components.

Circuit breaker 30 includes a chassis 32, which may be metal, such as steel, with chassis 32 supporting all of the circuit breaker components which include an operating mechanism 34 of any suitable type, and three insulated pole unit assemblies 36 (with three-phase circuit breakers), only one of which is shown since they are of similar construction. As is well known in the art, operating mechanism 34 includes a stored energy arrangement for closing circuit breaker 30, and a trip mechanism for opening it.

Each pole unit assembly 36 includes an insulative pole base 38 formed of a good electrical insulating material, such as a glass polyester, and upper and lower pole studs 40 and 42 for respective connection to a power source 44 and an electrical load 46. An electrical contact structure 45 includes a relatively stationary electrical contact structure 47 which has a contact head 48 which carries a main contact tip 50. Contact head 48 is mounted for limited pivotal movement on the upper pole stud 40 via a tubular pivot pin 52, and movement limiting means comprising a slot and pin combination 54.

Contact structure 45 also includes a movable electrical contact assembly 55 which has a contact arm 56 which is pivotally mounted on the lower pole stud 42 via a pivot pin 58. A contact head 60, which carries a contact tip 62, is fixed to contact arm 56. An insulative drive bar arrangement 64, which includes a drive bar yoke 66 and a drive bar 68, interconnects the movable contact assemblies 55 of the three pole units 36 for simultaneous movement thereof. For simplicity, the complete assembly of three movable contact assemblies 55 and drive bar arrangement 64 will hereinafter be referred to as movable contact means 70 of circuit breaker 30.

A plurality of insulative links 74 interconnect operating mechanism 34 with drive bar yoke 66, via a pivot pin 76 on yoke 66 and a pivot pin (not shown) on operating mechanism 34.

When circuit breaker 30 is in the closed position shown in FIG. 1, the movable contact assembly 55 applies a force to the stationary contact assembly 47, pivoting the stationary contact assembly 47 through the limited movement allowed, biasing a compression spring 83 in each pole unit 36. When operating mechanism 34 trips circuit breaker 30, movable contact means 70 is propelled towards the open position shown in FIGS. 2 and 3, due to the forces stored in springs 83, forces stored in other springs, such as tension spring 80, shown in FIG. 3, which is connected between a movable insulative barrier member 79, shown in phantom, which is mounted for movement on drive bar 68, and due to magnetic forces produced when circuit breaker 30 is opened under load.

Chassis 32 includes a top and bottom 84 and 86, respectively, a front 88, and first and second upstanding, spaced, parallel side portions, collectively referred to as side portions 90, with only the first side portion 90 being shown in the Figures. Shock absorber means 92 is provided for absorbing the kinetic energy and stopping movable contact means 70 when it is accelerated to the open position shown in FIG. 2, without bounce or rebound of the movable contact assembly, and without damage to circuit breaker components. Shock absorber means 92 includes first and second shock absorber mechanisms respectively mounted on the first and second upstanding side wall portions, with only the first shock absorber mechanism 94 mounted on the first side wall portion 90 being illustrated, since the first and second shock absorber mechanisms are of like construction.

Referring to FIG. 1, shock absorber mechanism 94 includes an elongated metallic bar 96 having first and second ends 98 and 100, respectively. The first end 98 is pivotally mounted to the first upstanding side portion 90 of chassis 32 via a pivot pin 102. Pivot pin 102 is mounted to the left of, and below, the location of pivot pin 58, as viewed in FIG. 1.

Figure 2:
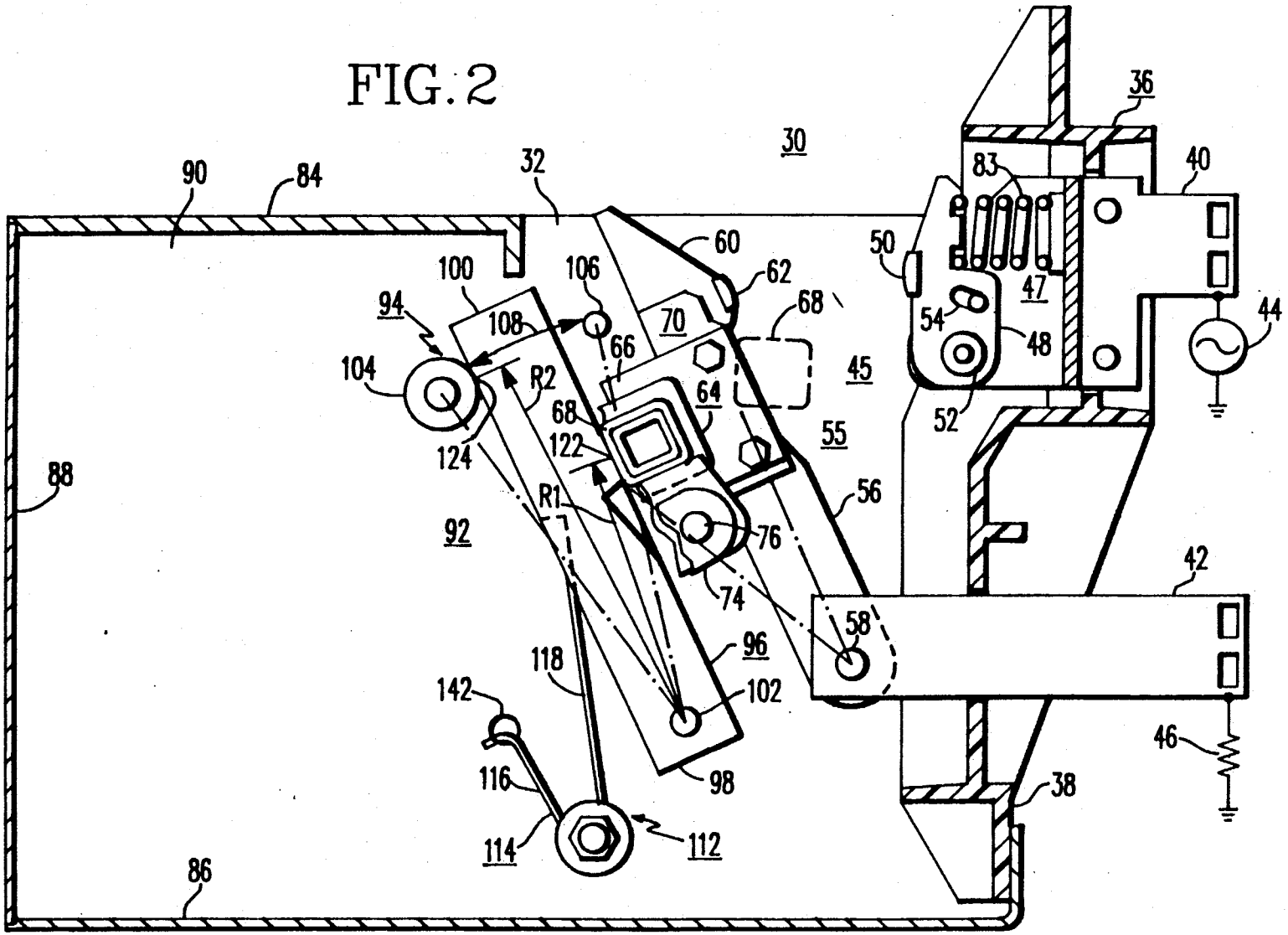
FIG. 2 is a view similar to FIG. 1, except illustrating the circuit breaker of FIG. 1 in an open position.

Shock absorber mechanism 94 further includes first and second limit means 104 and 106, respectively, which are fixed in predetermined spaced relation to the first upstanding wall portion 90 of chassis 32. The first and second limit means 104 and 106 are located to respectively establish first and second limit positions for the pivotable movement of metallic bar 96. As shown in FIG. 2, which illustrates circuit breaker 30 in the completely open position, the predetermined locations of the first and second limit means 104 define a pivotal movement range, indicated by arrow 108, which overlaps the pivotal movement range of drive bar 68, indicated by arrow 110.

Shock absorber mechanism 94 is completed by bias means 112, which lightly biases metallic bar 96 towards the second limit means 106. Bias means 112, as illustrated, may include a torsion spring 114 having a first leg 116 fixed to chassis 32, and a second leg 118 in contact with metallic bar 96. Spring 114 is configured such that it biases metallic bar 96 clockwise about pivot pin 102, as viewed in FIG. 1.

Figure 3:
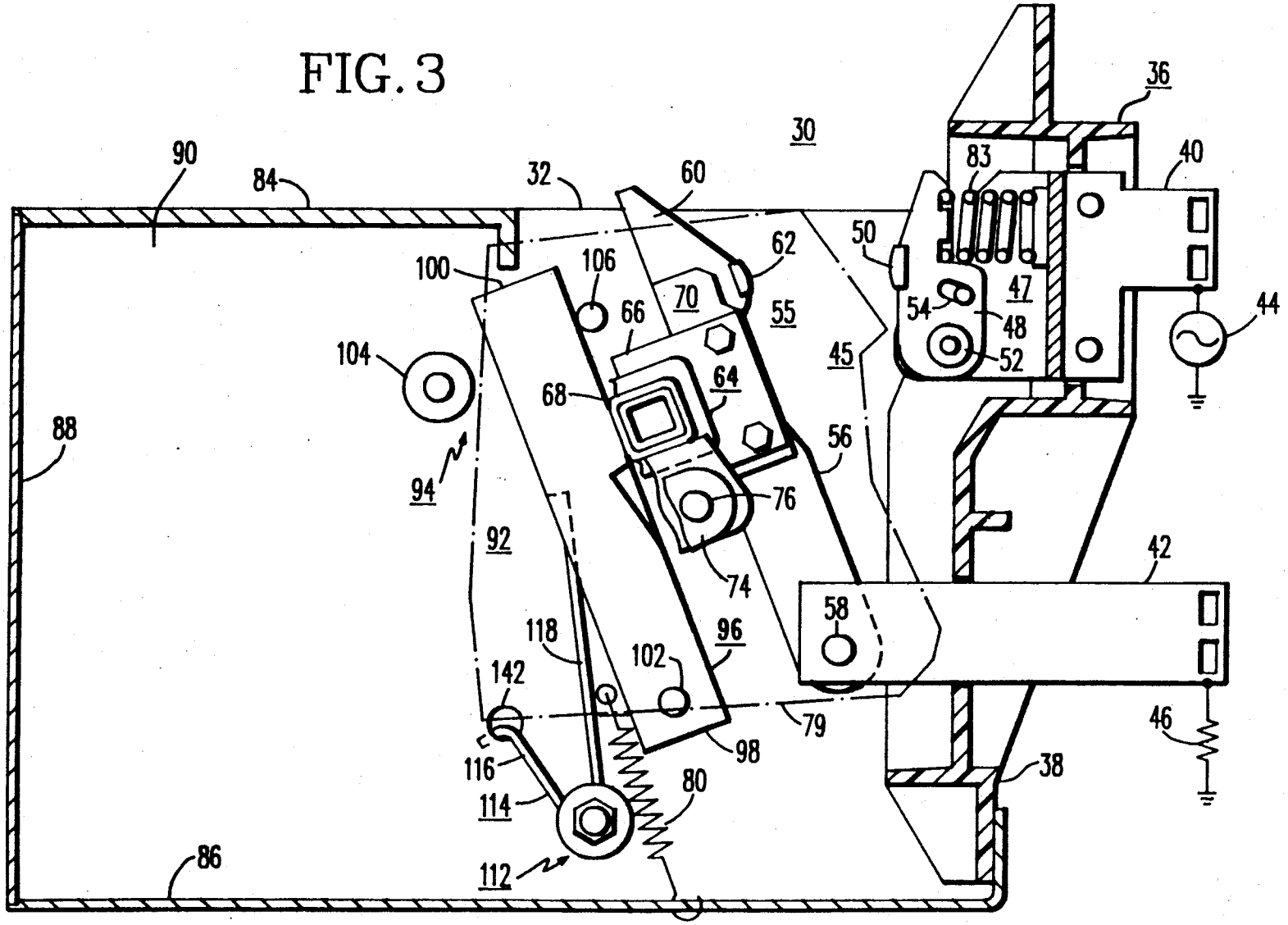
FIG. 3 is a view similar to FIG. 1, except illustrating the circuit breaker of FIG. 1 in the process of being opened, with a movable contact assembly being illustrated between the closed position shown in FIG. 1 and the open position shown in FIG. 2.
Figure 4:
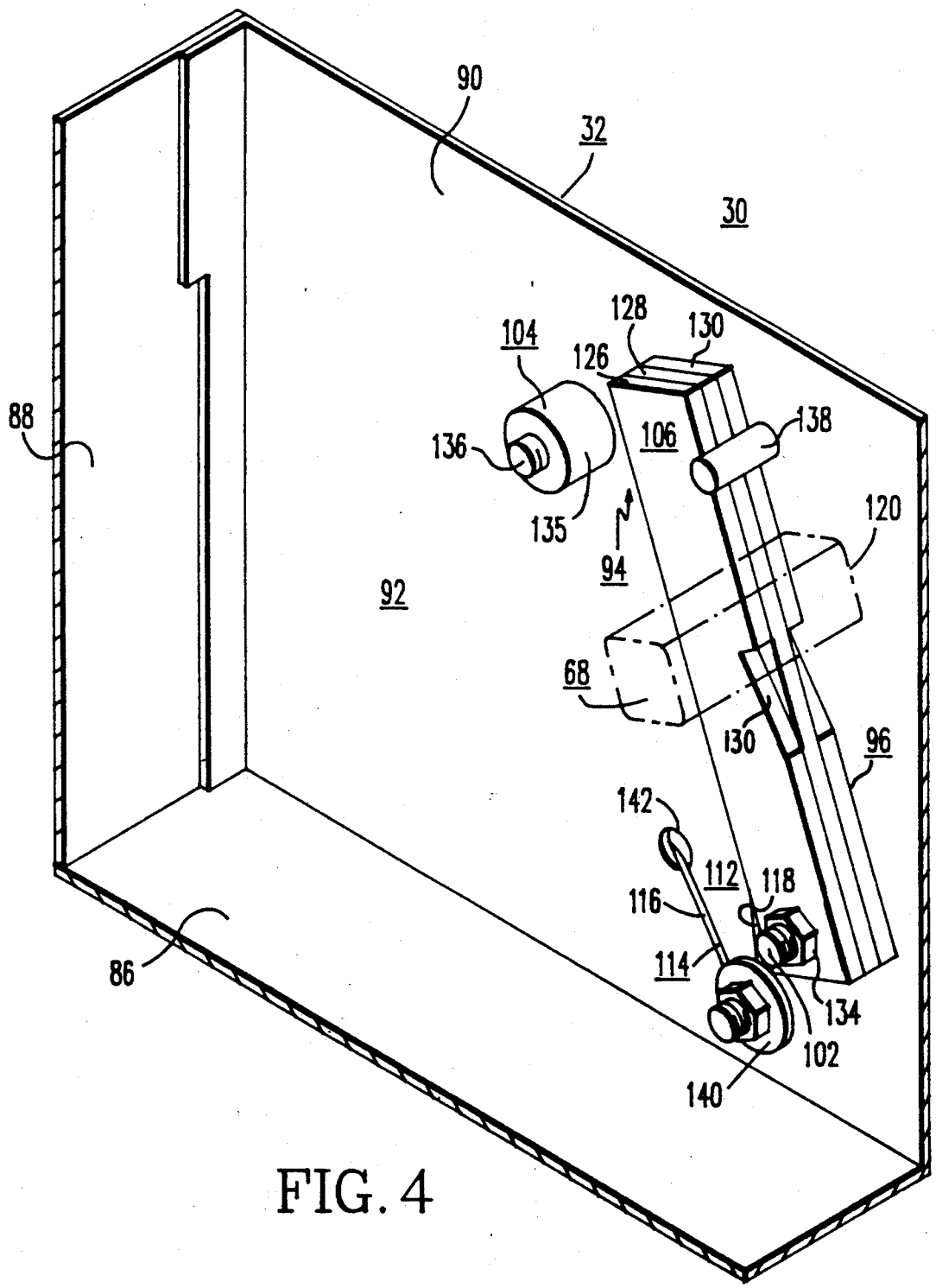
FIG. 4 is a fragmentary perspective view of the circuit breaker shown in FIGS. 1, 2 and 3, illustrating the circuit breaker and associated shock absorbing mechanism in the configuration shown in FIG. 3.

FIG. 3 illustrates a transitory position of movable contact means 70 as it is being propelled from the closed position shown in FIG. 1 to the open position shown in FIG. 2, at the instant that a first end 120 of drive bar 68, shown in FIG. 4, contacts metallic bar 96, and also the second end of drive bar 68 striking a like metallic bar in the shock absorber mechanism mounted on the second side wall portion of chassis 32. Drive bar 68 is dimensioned to extend between the first and second upstanding wall portions 90 of chassis 32, with a small clearance between each of its ends and the side wall surfaces, assuring that the drive bar 68 will simultaneously contact the metallic bars 96 of the shock absorber means 92 without skewing of the drive bar 68.

If the mass of the shock absorber means 92 were to be made the same as the mass of the movable contact means 70, when the rapidly moving drive bar 68 strikes metallic bar 96, drive bar 68 and the associated movable contact assemblies 55 would stop without bounce or rebound, similar to the way a cue ball stops when it strikes an object ball, instantly transferring all of its kinetic energy to metallic bars 96. The mass of the shock absorber means 92, however, is deliberately selected to be less than the mass of the movable contact means 70, which is not only more practical from a size and cost viewpoint, but it advantageously removes the kinetic energy from the movable contact means 70 in a series of two or more rapid steps. Thus, when the rapidly moving drive bar 68 strikes metallic bars 96, movable contact means 70 is slowed down, without bounce or rebound, but movable contact means 70 still retains some kinetic energy which maintains its original movement direction. Metallic bars 96 are propelled against their associated first limit means 104, which are firmly attached to chassis walls 90, and designed to absorb the kinetic energy of metallic bars 96 and transmit it into the metallic chassis 32. The metallic bars 96 bounce off their associated first limit means 104 and they are struck again by the still advancing movable contact means 70. Additional kinetic energy is removed from movable contact means 70, slowing it still further, again without bounce or rebound. This same action may occur again before movable contact means 70 is brought to rest against metallic bars 96, and with metallic bars at rest against their associated first limit means 104. Thus, the result of stopping movable contact means 70 without rebound is achieved, with economically sized metallic bars 96, which take up very little space within chassis 32, while transferring the kinetic energy of contact means 70 into the first limit means 104 and chassis 32 in non-damaging steps.

As hereinbefore stated, bias means 112 provides a very small biasing force against metallic bar 96, i.e., the biasing force is selected to provide substantially no resistance to movement of metallic bar 96 towards the first limit means 104 when metallic bar 96 is struck by the movable contact means 70. Metallic bar 96 can rapidly and repeatedly bounce off the first limit means 104 without any deleterious effects, such as may be caused if movable contact means 70 were to rebound, which could cause arc re-strike.

After the kinetic energy is removed from movable contact means 70, movable contact means 70 is maintained in the fully open position of circuit breaker 30 shown in FIG. 2 by gravity and by the, tension springs 80 shown in FIG. 3. In the fully open position, drive bar 68 rests against metallic bar 96, overcoming the slight bias provided by bias means 112, and the metallic bar 96 rests against the first limit means 104, and thus metallic bar 96 and the first limit means 104 cooperatively establish the open limit for the movable contact means 70.

While the shock absorber means 92 is arranged to remove the kinetic energy from the movable contact means 70 in steps, it is still desirable to remove the kinetic energy from the movable contact means 70 during each contact with the shock absorber means 92 as efficiently as possible. Thus, the smaller mass of the shock absorber assembly 92 should be made to appear as large as possible to the larger mass of the on-coming movable contact means kinetic energy from the shock absorber means 92 inefficiently, to minimize shock to the circuit breaker 30 and minimize damage to the first limit means 104, and thus the mass of metallic bars 96 should appear to be as small as possible to the first limit means 104. FIG. 2 illustrates an implementation of this desirable aspect of the preferred embodiment of the invention set forth in the Figures, wherein the drive bar 68 contacts metallic bar 96 intermediate ends 98 and 100 with a first radius R1 from pivot pin 102 to the contact point 122, and metallic bar 96 contacts the first limit means 104 relatively closer to the second end 100, with a second radius R2 from pivot pin 102 to the contact point 124. The second radius R2 is deliberately made substantially larger than the first radius R1, providing the most favorable transfer of kinetic energy from movable contact means 70 to chassis 32. The first radius R1 should be selected such that drive bar 68 strikes metallic bars 96 at or near their percussion centers, which will cause the maximum transfer of kinetic energy to metallic bars 96. The center of percussion may be thought of as equivalent to the "center of gravity" of the inertia forces acting on all particles of the body, just as the actual center of gravity is the point through which passes the resultant weight of all particles of a body. With a long rotational slender rod, the center of percussion is close to the center of gravity of the distributed effective forces, i.e., a point about ⅔ of the length of the rod from the point of support and radially outward from the axis of rotation. While metallic bars 96 are not exactly slender rods, the desired contact point 122 is still approximately two thirds of the length of metallic bar 96 measured from the pivot pin 102.

The larger second radius R2 reduces the force applied to the first limit means 104, similar to hitting a ball at the end of a bat instead of at the "sweet spot". Also, since the placement of the first limit means 104 establishes the open limit of circuit breaker 30, the positioning of the first limit means 104 is important, and the larger the second radius R2 the more relaxed are the locational tolerances when positioning the first limit means 104 on the chassis walls 90.

FIG. 4 is a fragmentary perspective view of shock absorber mechanism 94, setting forth a preferred constructional embodiment of the invention. To obtain the desired mass for metallic bar 96, it is formed of a plurality of metallic plate members of like construction, which are firmly attached together, such as the illustrated first, second and third plate members 126, 128 and 130, respectively. Each plate member, such as the first plate member 126, preferably includes a notch 132 in one edge thereof, with the notch 132 of the second plate member 128 facing spring arm 118, and with the notches 132 of the first and third plate members 126 and 130 facing in the opposite direction, such that notch 132 in plate member 128 forms a pocket in which the end of the second spring arm 118 is disposed.

As illustrated in FIG. 4, the pivot pin 102 may be formed by a bolt, with a nut 134 and suitable spacers (not shown) firmly pivotally attaching metallic bar 96 to chassis wall 90.

The first limit means 104, since it must withstand the forces applied to it by metallic bar 96, may include a relatively large diameter metallic cylindrical member 135 having a tapped opening for receiving a bolt 136 which firmly attaches member 135 to the inner surface of upstanding wall portion 90 of chassis 32.

The second limit means 106 does not have to absorb any significant forces, as it merely stops metallic bar under the light urging of bias means 112. Thus, the second limit means 106 may simply be a pin 138 which is suitably fixed to chassis wall 90, such as by welding, or by tapping an opening in wall 90 and providing pin 138 with complementary threads.

The bias means 112 may have its apex attached to wall 90 by a nut, bolt and washer combination 140, and the end of the first leg portion 116 may engage an opening 142 in chassis wall 90.

We claim:

1. A circuit breaker comprising a chassis; electrical contact means insulatively supported by the chassis, with the electrical contact means including pivotable first electrical contact means and relatively stationary second electrical contact means; means for pivoting the first electrical contact means between closed and open positions in which the first and second contact means are respectively engaged and disengaged, with the first contact means having a first movement range which includes first and second limits at the open and closed positions, respectively; and shock absorbing means for absorbing energy from the movement of the first electrical contact means, characterized by:

said shock absorber means including at least one metallic bar pivotally mounted on the chassis, first and second limit means which respectively establish first and second limit positions for the pivotable movement of said metallic bar, with the first and second limit means defining a second movement range having a portion which overlaps a portion of said first movement range, and bias means biasing the metallic bar towards the second limit position of the second movement range, whereby the first electrical contact means, during movement to the open position thereof, strikes the metallic bar, removing kinetic energy from the first electrical contact and pivoting the metallic bar against the first limit means.

2. The circuit breaker of claim 1 wherein the first limit means is fixed to the chassis, whereby the first limit means and chassis absorb energy from the movement of the metallic bar.

3. The circuit breaker of claim 1 wherein the bias means includes a spring having a biasing force selected to provide substantially no resistance to movement of the metallic bar towards the first limit means when the metallic bar is struck by the first contact means.

4. The circuit breaker of claim 1 wherein the chassis includes first and second upstanding side walls, with the metallic bar being pivotally mounted on the first upstanding side wall, and with the first and second limit means being fixed to the first upstanding side wall, and including a second metallic bar pivotally mounted on the second upstanding side wall, third and fourth limit means fixed to the second upstanding side wall which establish first and second limit positions for the pivotable movement for the second metallic bar which define a third movement range which is similar to the second movement range, and bias means biasing the second metallic bar towards the second limit means of the third movement range, and wherein the first electrical contact means includes a drive bar which extends between the first and second upstanding walls of the chassis, with the drive bar having first and second ends which respectively contact the at least one metallic bar and said second metallic bar during the opening of the first electrical contact means.

5. The circuit breaker of claim 1 wherein the metallic bar and first limit means cooperatively define the first limit at the open position of the first electrical contact means, with the first electrical contact means being in contact with the metallic bar and with the metallic bar being in contact with the first limit means.

6. The circuit breaker of claim 1 wherein the metallic bar has first and second ends, which the first end being pivotally mounted on the chassis, and wherein the first electrical contact means strikes the metallic bar at a first contact point, providing a first dimension from the first end to the first contact point, and wherein the metallic bar strikes the first limit means at a second contact point, providing a second dimension from the first end to the second contact point which exceeds the first dimension.

7. The circuit breaker of claim 6 wherein the first dimension is about two thirds of the length of the metallic bar, and the second contact point is closely adjacent to the second end of the metallic bar.

8. The circuit breaker of claim 1 wherein the mass of the metallic bar is selected such that the electrical contact strikes the metallic bar more than once as the electrical contact is slowed to a stop.

* * * * *